US005834095A

United States Patent [19]

Dutkiewicz et al.

[11] Patent Number: 5,834,095

[45] Date of Patent: Nov. 10, 1998

[54] TREATMENT PROCESS FOR CELLULOSIC FIBERS

[75] Inventors: Jacek Dutkiewicz, Appleton; Krzysztof Andrzej Szymonski, Neenah, both of Wis.; Gerard Martin Aberson, Cumming, Ga.; Tong Sun, Neenah, Wis.

[73] Assignee: Kimberly-Clark Worldwide, Inc., Neenah, Wis.

[21] Appl. No.: 767,608

[22] Filed: Dec. 17, 1996

[51] Int. Cl.[6] ..... D21C 9/00; D21H 15/04

[52] U.S. Cl. ..... 428/191; 428/192; 428/357; 428/364; 428/397; 162/9; 162/100; 162/157.6; 162/182; 162/201; 8/116.1; 8/116.4; 8/120; 8/149.2

[58] Field of Search ..... 8/116.4, 116.1, 8/120, 149.2; 428/364, 191, 192, 357, 397; 162/9, 100, 157.6, 182, 201

[56] References Cited

U.S. PATENT DOCUMENTS

| | | | |
|---|---|---|---|
| 2,116,544 | 5/1938 | Schur | 91/70 |
| 3,224,926 | 12/1965 | Bernardin | 162/146 |
| 3,339,550 | 9/1967 | Haaften | 128/290 |
| 3,440,135 | 4/1969 | Chung | 162/157 |
| 3,455,778 | 7/1969 | Bernardin | 162/113 |
| 4,650,127 | 3/1987 | Radwanski et al. | 241/28 |
| 4,701,294 | 10/1987 | Radwanski et al. | 264/518 |
| 4,710,187 | 12/1987 | Boland et al. | 604/385 A |
| 4,762,521 | 8/1988 | Roessler et al. | 604/38 SA |
| 4,767,586 | 8/1988 | Radwanski et al. | 264/113 |
| 4,770,656 | 9/1988 | Proxmire et al. | 604/393 |
| 4,798,603 | 1/1989 | Meyer et al. | 604/378 |
| 4,898,642 | 2/1990 | Moore et al. | 162/157.6 |
| 5,190,563 | 3/1993 | Herron et al. | 8/120 |
| 5,225,047 | 7/1993 | Graef et al. | 162/9 |
| 5,324,391 | 6/1994 | Carney et al. | 162/9 |
| 5,376,144 | 12/1994 | McClain et al. | 8/116.4 |
| 5,399,240 | 3/1995 | Graef et al. | 162/9 |
| 5,484,896 | 1/1996 | Naieni et al. | 530/504 |
| 5,501,768 | 3/1996 | Hermans et al. | 162/9 |

FOREIGN PATENT DOCUMENTS 0 399 564 A3 11/1990 European Pat. Off. ..... A61L 15/00

OTHER PUBLICATIONS

Back, E. L., "Cellulose bei hohen Temperaturen: Selbstvernetzung, Glasumwandlung und Schmelzen unter Einwirkung von Laserstrahlen," *Das Papier,* (Darnstadt), 27, Jahrgang, Heft 10A, 1973, pp. 475–483.

Cohen, W. E., A. J. Stamm, and D. J. Fahey, "Dimensional Stabilization of Paper by Catalyzed Heat Treatment," *TAPPI,* vol. 42, No. 11, Nov. 1959, pp. 904–908.

Forsslund, Ingemar and Lennart Ivnas, "What is Behind the success of flash drying in Scandinavia?" *Appita,* vol. 30, No. 2, Sep. 1976, pp. 161–164.

Hernadi, A. and J. Domotor, "Water Take–Up and Swelling Of The Cellulose Fibres After Thermal Treatment," *Cellulose Chem. Technol.,* vol. 15, No. 1, 1981, pp. 63–75.

Stamm, A. J., "Dimensional Stabilization of Paper by Catalyzed Heat Treatment and Cross–Linking with Formaldehyde," *TAPPI,* vol. 42, No. 1, Jan. 1959, pp. 44–50.

*Primary Examiner*—Richard Weisberger
*Attorney, Agent, or Firm*—John R. Schenian

[57] ABSTRACT

Disclosed is a process for treating cellulosic fibers using high temperatures that is effective to result in modified cellulosic fibers that exhibit desired properties such as water retention values and wet curl values. The high temperature process is quite efficient and has been found to produce cellulosic fibers that are essentially uniformly treated. Also disclosed is a handsheet prepared from the treated cellulosic fibers for use in disposable absorbent products.

25 Claims, No Drawings

TREATMENT PROCESS FOR CELLULOSIC FIBERS

BACKGROUND OF THE INVENTION

1. Field of the Invention

The present invention relates to a process for treating cellulosic fibers. The cellulosic fibers prepared from such a process may be used to prepare a handsheet or other structure that may be used in a disposable absorbent product intended for the absorption of fluids such as body fluids. Other possible applications of these fibers include various disposable paper products such as tissue and towel.

2. Description of the Related Art

Cellulosic fibers are well known and are used in a wide variety of applications. However, natural or generally untreated cellulosic fibers have been found to generally not provide a level of performance that is desired in certain applications such as the absorption or handling of fluids such as body fluids. As such, it is often desirable to increase the liquid absorbent capacity or the resiliency of the cellulosic fibers being used in such applications. Thus, for some applications, it has been recognized that the cellulosic fibers being used should first be structurally modified in order to improve the performance of such modified fibers in a particular application.

One known method for modifying cellulosic fibers is to chemically crosslink the cellulosic fibers. In general, a chemical crosslinking agent is added to either a solution containing cellulosic fibers or to swollen cellulosic fibers. The chemical crosslinking agent is then allowed to form crosslinks either within an individual cellulosic fiber or between separate cellulosic fibers. Such processes inherently result in the use of a separate crosslinking agent thereby increasing the costs of manufacturing the chemically crosslinked cellulosic fibers. Additionally, the use of certain crosslinking agents typically requires specialized handling procedures, further increasing the costs of manufacturing, and potentially limiting the applications for which the chemically crosslinked cellulosic fibers may be used. Another disadvantage concerning the use of chemical crosslinking agents is that they are often based on chemicals such as aldehydes which exhibit certain degrees of toxicity.

A variety of chemical treatments of cellulosic fibers are also known. An example of a well known chemical treatment of cellulosic fibers is a mercerization process wherein cellulosic fibers are treated with, typically, sodium hydroxide under suitable conditions to convert the cellulose from its native form into a more thermodynamically stable, less crystalline form. Because the mercerized cellulose is less crystalline and more amorphous, the mercerized cellulose is generally more accessible for further treatment with additional reagents.

These and other known processes for chemically treating cellulosic fibers typically disperse the cellulosic fibers in a solvent, such as an aqueous solution. However, it has been generally recognized that in order to ensure proper mixing of the cellulosic fibers and whatever chemicals are being used to treat the cellulosic fibers as well as to ease the bulk transport of the treatment mixture, such known processes must have the cellulosic fibers present in the solvent at a low consistency. Such processes therefore generally result in the use of more of the solvent in which the chemical treatment takes place, or the chemical treatment agent being used, than would ideally be needed, thereby increasing the costs of manufacturing the chemically treated cellulosic fibers. Additionally, the use of sodium hydroxide, or other caustic agents, typically requires specialized handling procedures as well as recycling processes to ensure that such materials are not discharged to the environment.

Another known method for modifying cellulosic fibers is to mechanically treat the cellulosic fibers. One example of such a mechanical treatment process is wherein the cellulosic fibers are subjected to a high shear force which generally results in highly twisted or curled cellulosic fibers. However, such mechanical treatment processes generally require the use of specialized equipment and the use of large amounts of energy, thereby increasing the costs of manufacturing the mechanically treated cellulosic fibers. Besides, without any additional treatment, the fibers modified only by mechanical treatment generally do not preserve their curl in wet conditions because they swell and collapse. Therefore, mechanical modification is generally not quite sufficient for cellulosic fibers which are used for absorbent structures requiring more porosity or capacity.

It is therefore an object of the present invention to provide a process for the preparation of treated cellulosic fibers in which the amount of solvent and chemical treatment agents used in the process is minimized or completely eliminated.

It is also an object of the present invention to provide a process for the preparation of treated cellulosic fibers in which the cellulosic fibers are essentially uniformly treated.

It is also an object of the present invention to provide a process for the preparation of treated cellulosic fibers in which relatively high temperatures are used.

It is also an object of the present invention to provide a process for the preparation of treated cellulosic fibers which will significantly reduce the costs of manufacturing.

It is also an object of the present invention to prepare modified cellulosic fibers that exhibit improved liquid handling properties as compared to untreated cellulosic fibers.

It is also an object of the present invention to prepare modified cellulosic fibers that exhibit improved bulk properties as compared to untreated cellulosic fibers.

It is also an object of the present invention to prepare modified cellulosic fibers that exhibit less bonding between the fibers as compared to untreated cellulosic fibers.

SUMMARY OF THE INVENTION

The present invention concerns an efficient and effective manner for treating cellulosic fibers as well as the treated cellulosic fibers prepared from such a process.

One aspect of the present invention concerns a process for treating cellulosic fibers wherein the cellulosic fibers are treated at a relatively high temperature that is effective to result in modified cellulosic fibers that exhibit desired properties.

One embodiment of such a process for treating cellulosic fibers comprises treating dry cellulosic fibers at a temperature above about 150° C. for an amount of time that is effective to result in modified cellulosic fibers that exhibit a Water Retention value that is less than about 1.0.

In another aspect, the present invention concerns the modified cellulosic fibers prepared by the process disclosed herein.

One embodiment of such an aspect of the present invention is modified cellulosic fibers that exhibit a Water Retention value that is less than about 1.0 that are prepared by a process comprising treating dry cellulosic fibers at a temperature above about 150° C. for an effective amount of time.

In another aspect, the present invention concerns an absorbent structure comprising modified cellulosic fibers prepared by the process disclosed herein.

One embodiment of such an absorbent structure is a handsheet comprising the modified cellulosic fibers prepared by the process disclosed herein, wherein the handsheet is prepared by a wet-laid process.

DETAILED DESCRIPTION OF THE PREFERRED EMBODIMENTS

It has been discovered that, by using a high-temperature process for treating cellulosic fibers, and by using appropriate treatment conditions, modified cellulosic fibers exhibiting desired properties may be prepared by an efficient and effective process.

A wide variety of cellulosic fibers can be employed in the process of the present invention. Illustrative cellulosic fibers include, but are not limited to, wood and wood products, such as wood pulp fibers; non-woody paper-making fibers from cotton, from straws and grasses, such as rice and esparto, from canes and reeds, such as bagasse, from bamboos, form stalks with bast fibers, such as jute, flax, kenaf, cannabis, linen and ramie, and from leaf fibers, such as abaca and sisal. It is also possible to use mixtures of one or more cellulosic fibers. Suitably, the cellulosic fiber used is from a wood source. Suitable wood sources include softwood sources such as pines, spruces, and firs, and hardwood sources such as oaks, eucalyptuses, poplars, beeches, and aspens.

As used herein, the term "fiber" or "fibrous" is meant to refer to a particulate material wherein the length to diameter ratio of such particulate material is greater than about 10. Conversely, a "nonfiber" or "nonfibrous" material is meant to refer to a particulate material wherein the length to diameter ratio of such particulate material is about 10 or less.

In the process of the present invention, it has been discovered that the use of high temperature alone can be sufficient to effectively modify cellulosic fibers such that the modified cellulosic fibers exhibit desired properties, particularly desired liquid absorbency properties.

In general, any combination of temperature and time which is effective in achieving a desired degree of modification, without undesirable damage to the cellulosic fibers, so that the cellulosic fibers exhibit the desired liquid absorbency properties as described herein, is suitable for use in the present invention.

Generally, if the temperature used is too low, there will not be a substantial and/or effective amount of modification of the cellulosic fibers that occurs. Also, generally, if the temperature used is too high, a substantial degradation of the cellulosic fibers may occur which will negatively affect the properties exhibited by the crosslinked cellulosic fibers. As such, as a general rule, the cellulosic fibers will be heat treated at a temperature within the range beneficially from about 150° C. to about 300° C., suitably from about 150° C. to about 250° C., more suitably from about 170° C. to about 250° C., and most suitably from about 190° C. to about 220° C.

Generally, the heat treating process will extend over a time period within the range of from about 1 second to about 300 minutes, beneficially from about 1 minutes to about 200 minutes, and suitably from about 5 minutes to about 100 minutes. In general, the higher the temperature employed, the shorter the period of time generally necessary to achieve a desired degree of modification of the cellulosic fibers. As such, it may be possible to achieve essentially equivalent amounts of modification for different cellulosic fiber samples by using different combinations of high temperatures and times.

It has also been discovered that by using a heat treatment catalyst to aid in the heat treatment of the cellulosic fibers, the time necessary to achieve a desired level of modification of the cellulosic fibers may be shortened or, alternatively, the level of modification achieved may be increased by using a similar amount of time. Nonetheless, similarly modified cellulosic fibers exhibiting desired liquid absorptive properties can generally be achieved with or without the use of a heat treatment catalyst.

Catalysts useful in the high temperature treatment process of the present invention include, but are not limited to, phosphoric acid, cupric acetate, ferric chloride, aluminum sulfate, sodium bisulfite, boric acid, zirconium containing compounds, and mixtures thereof. The catalyst is generally used in an amount beneficially between about 0.001 weight percent to about 1 weight percent, suitably between about 0.002 weight percent to about 0.5 weight percent, and more suitably between about 0.003 weight percent to about 0.3 weight percent, wherein the weight percent of the catalyst is based on the total weight of cellulosic fibers. Alternatively, the catalyst may generally be used in an amount such that the cellulosic fibers, when in an aqueous solution at a consistency of about 2 weight percent, exhibit a pH that is beneficially between about 2 to about 6 and suitably between about 2 to about 5.5. When a catalyst is used that provides an acidic character to the cellulosic fibers, it may be desired to neutralize the cellulosic fibers after the heat treatment process.

As used herein, "consistency" is meant to refer to the concentration of the cellulosic fibers present in a mixture. As such, the consistency will be presented as a weight percent representing the weight amount of the cellulosic fibers present in a mixture divided by the total weight amount of cellulosic fibers and water present in such mixture, multiplied by 100.

In general, the method of applying the catalyst to the cellulosic fibers in not critical. One suitable method of applying the catalyst to the cellulosic fibers is to spray an aqueous solution of the catalyst on the cellulosic fibers. However, to ensure the effective distribution of a catalyst within a cellulosic fiber sample, it may be desirable to prepare an aqueous mixture comprising the cellulosic fibers and a catalyst wherein the aqueous mixture is agitated, stirred, or blended to effectively disperse the catalyst throughout the cellulosic fibers.

The cellulosic fibers are typically mixed with an aqueous solution beneficially comprising at least about 30 weight percent water, suitably about 50 weight percent water, more suitably about 75 weight percent water, and most suitably 100 weight percent water. When another liquid is employed with the water, such other suitable liquids include methanol, ethanol, isopropanol, and acetone. However, the use or presence of such other non-aqueous liquids may impede the formation of an essentially homogeneous mixture such that the cellulosic fibers and the catalyst do not effectively disperse into the aqueous solution and effectively or uniformly mix with one another. Such a mixture should generally be prepared under conditions that are sufficient for the cellulosic fibers and catalyst to be effectively mixed together. Generally, such conditions will include using a temperature that is between about 10° C. to about 100° C.

In general, cellulosic fibers are prepared by pulping or other preparation processes in which the cellulosic fibers are present in an aqueous solution. For use in the high-temperature treatment of the present invention, however, it is generally desired that the cellulosic fibers be relatively dry. As such, if present in an aqueous solution it is generally desired that the cellulosic fibers be recovered or otherwise dried of excess water or other solvents prior to treatment with high temperature.

As used herein, recovery of the cellulosic fibers and a heat treatment catalyst, if used, from a mixture is meant to represent that substantially all of the water and, if present, nonsolvent is separated from the cellulosic fibers prior to treatment with a high temperature to modify the cellulosic fibers. It will be appreciated, however, that, even after removal of substantially all of the water and nonsolvent, a small amount of water and nonsolvent may remain entrapped within the structure of the cellulosic fibers. The amount of water and nonsolvent remaining entrapped within the structure of the cellulosic fibers will typically depend on the method and conditions under which the cellulosic fibers are recovered. As used herein, a "dry" cellulosic fiber will represent that a cellulosic fiber contains less than about 15 weight percent, suitably less than about 10 weight percent, and more suitably less than about 5 weight percent of liquid such as water and nonsolvent, based on the weight of the cellulosic fibers.

It has been found that the cellulosic fibers should be relatively dry when the cellulosic fibers are heat treated in the process of the present invention. This is because the presence of a relatively high level of liquid in the cellulosic fibers is not favorable because of the reversibility of the condensation processes associated with cellulosic fiber modification. Furthermore, the presence of water generally does not allow for heating of the cellulosic fibers above 100° C. under atmospheric pressure.

The equipment or method used to treat the cellulosic fibers with a high temperature is generally not critical. One piece of equipment that has been found suitable for use in the present invention is a pulse combustion burner, such as a Lennox G14 series unit (liquid propane gas) furnace, Model G21Q4/5-5-100-2, availalable from the Lennox Corporation. A pulse combustion burner essentially consists of a mixing and combustion chamber with an open tailpipe at one end and a set of two valves at the other end. The two valves control the flow of air and a combustible gas, such as propane gas, into the chamber. The tail pipe, which is narrower than the combustion chamber, acts as an exhaust for the hot combustion products. The combustion is started by supplying air through one of the valves with a small blower and gas through the other valve under line pressure. The gas mixture is ignited by an electrical spark. A positive pressure is created by the combustion gases causing the air and gas valves to close. The combustion products exit through the exhaust pipe due to the positive pressure wave. The combustion is followed by a contraction in the system which produces a momentary negative pressure allowing the valves to open and admit a fresh supply of gases. The fresh charge automatically ignites, without the need of a spark ignition, and the cycle repeats itself. The number of cycles per second will depend on the dimension of the system, particularly on the length of the tail pipe. A pulse combustion burner may be used as a means of drying a slurry by injecting the slurry at a point in the combustion chamber or the exhaust pipe.

The heat treating process generally causes the cellulosic fibers to become modified. Without intending to be bound hereby, it is believed that the heat treating process causes the cellulosic fibers to undergo a degree of self-crosslinking through the formation of ester and/or ether linkages. Esterification is believed to occur between carboxyl groups and hydroxyl groups on the original cellulosic polymer or those resulting from oxidation of the cellulosic fibers due to the heat treating. Etherification is believed to possibly occur by reaction between the hydroxyl groups themselves or between hydroxyl groups and aldehyde groups. Aldehyde groups are typically more abundant in partly oxidized cellulose.

Those skilled in the art will recognize that the presence of crosslinks formed by esterification or etherification can generally be detected through various analytical techniques. For example, infrared transmission spectroscopy can be used to study and verify the presence of ester and ether crosslinks in cellulosic fibers.

The heat treated cellulosic fibers, in addition to being modified, have been discovered to exhibit improved properties that make such heat treated cellulosic fibers suitable for use in liquid absorption or liquid handling applications.

In one embodiment of the present invention, the heat treated cellulosic fibers desirably swell less in water than untreated cellulosic fibers. The swellability of a cellulosic fiber in water may be quantified by a Water Retention value, as measured according to the test method described herein, which measures the maximum amount of water which is absorbed by the cellulosic fiber, excluding and water in the voids created by fiber aggregates. A lower Water Retention value represents a reduction in the swellability of the cellulosic fibers and generally reflects a higher degree of crosslinking of the cellulosic fibers.

As used herein, the cellulosic fibers will be considered to be effectively treated by heat treatment when the cellulosic fibers exhibit a Water Retention value that is less than about 1.0 gram of water per gram of cellulosic fiber (gram per gram), beneficially less than about 0.9 gram per gram, more beneficially less than about 0.8 gram per gram, suitably less than about 0.7 gram per gram, and more suitably less than about 0.6 gram per gram. In contrast, cellulosic fibers that have not been heat treated or that have been treated at too low of a temperature generally exhibit a Water Retention value that is greater than about 1.0 gram per gram and generally greater than about 1.2 gram per gram.

Cellulosic fibers treated according to the process of the present invention generally have different structural properties as compared to untreated cellulosic fibers. In one aspect, such treated cellulosic fibers will exhibit a rigid structure, probably due to an internal crosslinking of cellulose. Such a rigidity generally results in the treated cellulosic fibers being more stiff and more resilient than untreated cellulosic fibers. It is generally desired that cellulosic fibers be relatively more stiff and relatively more resilient because such properties generally add to the bulk and stability, and particularly in a wet state, of a fibrous matrix prepared from the cellulosic fibers.

Cellulosic fibers suitable for use in the present invention are generally without a substantial amount of curl prior to the heat treatment process. After such heat treatment process, the treated cellulosic fibers will generally exhibit a desired level of stable curl. As such, the process of the present invention generally does not require the use of any additional additives to the cellulosic fibers during the high-temperature process or any post-treatment steps after the heat treatment of the fibers to achieve the desired curls.

It has been discovered, however, that when the cellulosic fibers are under tension, as for instance in a fibrous matrix where the cellulosic fibers are bonded to one another by hydrogen bonds or by physical entanglement, their ability to curl may be rather limited. As such, it is desirable that the cellulosic fibers be heat treated when the cellulosic fibers are as individualized as possible. Thus, if the cellulosic fibers are originally received in an aggregate form, such as a sheet from a pulp mill, it may be desirable to first subject the cellulosic fibers to a process using a distribution means, such as a fiberizer or a disperser, prior to heat treating the cellulosic fibers. Furthermore, such distribution processes may impart an initial curl to the cellulosic fibers which is then set as the cellulosic fibers are subjected to the heat treatment.

In one embodiment of the present invention, the cellulosic fibers will be considered to be effectively treated by the heat treatment process when the cellulosic fibers exhibit an effective Wet Curl value.

The curl of a fiber may be quantified by a curl value which measures the fractional shortening of a fiber due to kink, twists, and/or bends in the fiber. For the purposes of this invention, a fiber's curl value is measured in terms of a two dimensional plane, determined by viewing the fiber in a two dimensional plane. To determine the curl value of a fiber, the projected length of a fiber as the longest dimension of a two dimensional rectangle encompassing the fiber, I, and the actual length of the fiber, L, are both measured. An image analysis method may be used to measure L and I. A suitable image analysis method is described in U.S. Pat. No. 4,898,642, incorporated herein in its entirety by reference. The curl value of a fiber can then be calculated from the following equation:

$$\text{Curl Value}=(L/I)-1$$

Depending on the nature of the curl of a cellulosic fiber, such curl may be stable when the cellulosic fiber is dry but may be unstable when the cellulosic fiber is wet. The cellulosic fibers prepared according to the process of the present invention have been found to exhibit a substantially stable fiber curl when wet. This property of the cellulosic fibers may be quantified by a Wet Curl value, as measured according to the test method described herein, which is a length weighted mean curl average of a designated number of fibers, such as about 4000, from a fiber sample. As such, the Wet Curl value is the summation of the individual wet curl values for each fiber multiplied by the fiber's actual length, L, divided by the summation of the actual lengths of the fibers. It is hereby noted that the Wet Curl value, as determined herein, is calculated by only using the necessary values for those fibers with a length of greater than about 0.4 millimeter.

As used herein, the cellulosic fibers will be considered to be effectively treated by the heat treatment when the cellulosic fibers exhibit a Wet Curl value that is greater than about 0.10, beneficially between about 0.11 to about 0.3, more beneficially between about 0.11 to about 0.25, suitably between about 0.13 to about 0.22, and suitably between about 0.15 to about 0.20. In contrast, cellulosic fibers that have not been treated generally exhibit a Wet Curl value that is about 0.1 or less.

After the cellulosic fibers have been effectively heat treated, the treated cellulosic fibers are suitable for use in a wide variety of applications. However, depending on the use intended for the treated cellulosic fibers, such treated cellulosic fibers may be washed with water and, if needed, neutralized with any suitable base, such as sodium hydroxide, to a pH of about 6 or 7. If any additional processing procedures are planned because of the specific use for which the treated cellulosic fibers are intended, other recovery and post-treatment steps are also well known.

The cellulosic fibers treated according to the process of the present invention are suited for use in disposable absorbent products such as diapers, adult incontinent products, and bed pads; in catamenial devices such as sanitary napkins, and tampons; other absorbent products such as wipes, bibs, wound dressings, and surgical capes or drapes; and tissue-based products such as facial or bathroom tissues, household towels, wipes and related products. Accordingly, in another aspect, the present invention relates to a disposable absorbent product comprising the cellulosic fibers treated according to the process of the present invention.

In one embodiment of the present invention, the treated fibers prepared according to the process of the present invention are formed into a handsheet which might represent a tissue-based product. Such a handsheet may be formed by either a wet-laid or an air-laid process. A wet-laid handsheet may be prepared according to the method disclosed in the Test Methods section herein.

It has been discovered that a wet-laid handsheet prepared from the treated cellulosic fibers prepared according to the process of the present invention may exhibit a density that is lower than a wet-laid handsheet prepared from cellulosic fibers that have not been treated according to the process of the present invention.

It has also been discovered that a wet-laid handsheet prepared from the treated cellulosic fibers prepared according to the process of the present invention may exhibit a liquid wicking time that is faster than a wet-laid handsheet prepared from cellulosic fibers that have not been treated according to the process of the present invention.

It has also been discovered that a wet-laid handsheet prepared from the treated cellulosic fibers prepared according to the process of the present invention may exhibit a liquid wicking flux that is higher than a wet-laid handsheet prepared from cellulosic fibers that have not been treated according to the process of the present invention.

It has also been discovered that a wet-laid handsheet prepared from the treated cellulosic fibers prepared according to the process of the present invention may exhibit an increased bulk and higher absorbent capacity than a wet-laid handsheet prepared from cellulosic fibers that have not been treated according to the process of the present invention.

In one embodiment of the present invention, the treated cellulosic fibers prepared according to the process of the present invention are formed into a fibrous matrix for incorporation into an absorbent structure. A fibrous matrix may take the form of, for example, a batt of comminuted wood pulp fluff, a tissue layer, a hydroentangled pulp sheet, or a mechanically softened pulp sheet.

A fibrous matrix useful in the present invention may be formed by an air-laying process or a wet-laid process, or by essentially any other process known to those skilled in the art for forming a fibrous matrix.

In one embodiment of the present invention, a disposable absorbent product is provided, which disposable absorbent product comprises a liquid-permeable topsheet, a backsheet attached to the liquid-permeable topsheet, and an absorbent structure positioned between the liquid-permeable topsheet and the backsheet, wherein the absorbent structure comprises treated cellulosic fibers prepared using the process of the present invention.

Exemplary disposable absorbent products are generally described in U.S. Pat. No. 4,710,187; U.S. Pat. No. 4,762,521; U.S. Pat. No. 4,770,656; and U.S. Pat. No. 4,798,603; which references are incorporated herein by reference.

Those skilled in the art will recognize materials suitable for use as the topsheet and backsheet. Exemplary of materials suitable for use as the topsheet are liquid-permeable materials, such as spunbonded polypropylene or polyethylene having a basis weight of from about 15 to about 25 grams per square meter. Exemplary of materials suitable for use as the backsheet are liquid-impervious materials, such as polyolefin films, as well as vapor-pervious materials, such as microporous polyolefin films.

Absorbent products and structures according to all aspects of the present invention are generally subjected, during use, to multiple insults of a body liquid. Accordingly, the absorbent products and structures are desirably capable of absorbing multiple insults of body liquids in quantities to which the absorbent products and structures will be exposed during use. The insults are generally separated from one another by a period of time.

Test Procedures

Water Retention

A 0.5 gram cellulosic fiber sample was obtained and dispersed into about 200 grams of deionized water using a Hobart Company Model N 50 blender set on the low speed setting for about 30 seconds. The cellulosic fiber/water solution was transferred to a beaker and allowed to sit for about 16 hours. The excess water was decanted and the cellulosic fibers were placed into a centrifuge (Dynac II by Clay Adams, Division of Becton Dickinson & Co., Model 5025, serial 012, cat. No. 0103) tube fitted with a screen. The cellulosic fibers were then centrifuged under a force of about 1000 time gravity for about 20 minutes. The cellulosic fibers were then removed from the centrifuge tube and weighed (giving a wet weight $W_W$). The cellulosic fibers were then dried at about 105° C. for about 2 hours. The cellulosic fibers were then reweighed (giving a dry weight $W_D$). The Water Retention value is then calculated by subtracting the dry weight ($W_D$) from the wet weight ($W_W$) and then dividing that value by the dry weight ($W_D$). The Water Retention value is reported as the grams of water retained per gram of dry cellulosic fibers.

Wet Curl

The Wet Curl value for fibers was determined by using an instrument which rapidly, accurately, and automatically determines the quality of fibers, the instrument being available from OpTest Equipment Inc., Hawkesbury, Ontario, Canada, under the designation Fiber Quality Analyzer, OpTest Product Code DA93.

A sample of dried cellulosic fibers was obtained. The cellulosic fiber sample was poured into a 600 milliliter plastic sample beaker to be used in the Fiber Quality Analyzer. The fiber sample in the beaker was diluted with tap water until the fiber concentration in the beaker was about 10 to about 25 fibers per second for evaluation by the Fiber Quality Analyzer.

An empty plastic sample beaker was filled with tap water and placed in the Fiber Quality Analyzer test chamber. The <System Check> button of the Fiber Quality Analyzer was then pushed. If the plastic sample beaker filled with tap water was properly placed in the test chamber, the <OK> button of the Fiber Quality Analyzer was then pushed. The Fiber Quality Analyzer then performs a self-test. If a warning was not displayed on the screen after the self-test, the machine was ready to test the fiber sample.

The plastic sample beaker filled with tap water was removed from the test chamber and replaced with the fiber sample beaker. The <Measure> button of the Fiber Quality Analyzer was then pushed. The <New Measurement> button of the Fiber Quality Analyzer was then pushed. An identification of the fiber sample was then typed into the Fiber Quality Analyzer. The <OK> button of the Fiber Quality Analyzer was then pushed. The <Options> button of the Fiber Quality Analyzer was then pushed. The fiber count was set at 4,000. The parameters of scaling of a graph to be printed out may be set automatically or to desired values. The <Previous> button of the Fiber Quality Analyzer was then pushed. The <Start> button of the Fiber Quality Analyzer was then pushed. If the fiber sample beaker was properly placed in the test chamber, the <OK> button of the Fiber Quality Analyzer was then pushed. The Fiber Quality Analyzer then began testing and displayed the fibers passing through the flow cell. The Fiber Quality Analyzer also displayed the fiber frequency passing through the flow cell, which should be about 10 to about 25 fibers per second. If the fiber frequency is outside of this range, the <Stop> button of the Fiber Quality Analyzer should be pushed and the fiber sample should be diluted or have more fibers added to bring the fiber frequency within the desired range. If the fiber frequency is sufficient, the Fiber Quality Analyzer tests the fiber sample until it has reached a count of 4000 fibers at which time the Fiber Quality Analyzer automatically stops. The <Results> button of the Fiber Quality Analyzer was then pushed. The Fiber Quality Analyzer calculates the Wet Curl value of the fiber sample, which prints out by pushing the <Done> button of the Fiber Quality Analyzer.

Preparation of Wet-Laid Handsheet

A 17 inch by 17 inch standard handsheet having a basis weight of about 200 grams per square meter was prepared using a desired fiber sample by using a 16 inch by 16 inch cast bronze wet-laid handsheet former mold, available from Voith Corporation.

A British Disintegrator mixer, available from Testing Machines, Inc., was filled with about 2 liters of distilled water at room temperature (about 23° C.) and about 37.3 grams of the fiber sample. The counter on the British Disintegrator was set to zero and the cover was placed on the British Disintegrator. The British Disintegrator was turned on until the counter runs to about 600. Alternatively, the British Disintegrator may be run for about 5 minutes. A bucket was filled with about 8 liters of distilled water. The contents of the British Disintegrator was then also poured into the bucket. All the leftover fiber was also rinsed into the bucket.

The handsheet former, having an about 12 inch deep chamber, was filled with tap water to about 5 inches below the top of the handsheet former chamber. The contents of the bucket were then poured into the handsheet former chamber. A dedicated stirrer was then used to mix the suspension in the handsheet former chamber. The stirrer was moved slowly up and down 6 times to cause small vortexes, but to avoid causing large vortexes, in the square pattern of the handsheet former. The stirrer was then removed and the suspension was drained through the forming screen of the handsheet former. The handsheet former was then opened and two layers of blotting paper were placed on the top of the handsheet. A roller, having the equivalent of about 2.3 pounds of pressure per linear inch, was moved back and forth once on each of the left side, the right side, and the center of the formed handsheet. The blotting paper, with the formed handsheet attached, was then lifted off the forming screen. The blotting paper was then placed on a table such that the formed handsheet faced upwards. An 18 inch by 18 inch, 4 mesh stainless steel screen was placed on top of the handsheet. The blotting paper, handsheet, and screen were then flipped so that the screen was on the bottom and the blotting paper was on top. The blotting paper was then peeled off of the handsheet, leaving the handsheet on the screen. The edges of the handsheet were fastened to the screen using binder clips. The handsheet was left overnight to air-dry. The handsheet, attached to the screen, was then placed in an oven and dried at about 105° C. for about an hour. The handsheet was then removed from the oven and removed from the screen. The handsheet was then ready for evaluation for liquid distribution properties.

EXAMPLES

Example 1

A condensing, pulse combustion burner furnace, available from the Lennox Corporation under the designation Lennox G14 series unit (liquid propane gas) furnace, Model G21Q4/5-5-100-2, was fitted with a straight length of a two inch diameter tail pipe. Cellulosic fiber samples were prepared by mixing a southern softwood kraft pulp (available from Kimberly-Clark Corporation under the designation CR54 southern softwood kraft pulp) with water to form a mixture having a consistency of about 2 weight percent cellulosic fibers. If phosphoric acid was used as a crosslinking catalyst, the phosphoric acid was added to the 2 weight percent cellulosic fiber aqueous solution in an amount to give a 0.1 weight percent phosphoric acid, based on the weight of the cellulosic fibers, and the pH of the solution was measured. For some of the samples using phosphoric acid, ammonium hydroxide was then added to the solution in order to neutralize the solution to a pH of about 6.5. The 2 weight percent cellulosic fiber aqueous mixture was then centrifuged until the mixture had a consistency of about 33 weight percent cellulosic fibers. The mixtures were then dried at a temperature of about 50° C. until the mixture had a water content of about 6 weight percent, based on the weight of the cellulosic fibers.

Each cellulosic fiber sample was then introduced into the tail pipe of the furnace about 3 feet down stream from the combustion chamber via an inclined T-shaped piece of pipe. After the sample introduction port, the length of the exhaust pipe was about 8 feet. A piston was used to introduce each cellulosic fiber sample into the exhaust pipe. As a consequence of using the piston, each cellulosic fiber sample was carried down the length of the exhaust pipe by the hot compression waves as a clump of fibers rather than as individual fibers. It was observed that such clumps of the cellulosic fibers generally experienced uneven heating, as evidenced by the cellulosic fibers on the inside of the clumps being whiter than the cellulosic fibers on the outside of the clumps.

The cellulosic fiber samples were collected at the end of the exhaust pipe on an aluminum wire screen. Because the travel time of the cellulosic fiber samples through the exhaust pipe was less than about 1 second, the cellulosic fiber samples collected on the aluminum wire screen were kept in position at the end of the exhaust pipe for various periods of time in order to vary the exposure of the samples the combustion gases of the furnace. The temperature of the combustion gases at the end of the exhaust port was about 280° C. The temperature of the combustion gases at the cellulosic fiber samples inlet port was not measured. The results of these evaluations are summarized in Table 1, which lists the amount of phosphoric acid used, if any; if the solution was neutralized; the amount of time the cellulosic fiber sample was retained on the aluminum wire screen and the Water Retention values for the sample.

TABLE 1

| $H_3PO_4$ Concentration | Heating Time (Seconds) | Water Retention Value (g/g) |
|---|---|---|
| None | 0 | 0.81 |
| None | 10 | 0.68 |
| None | 20 | 0.59 |
| 0.1% | 0 | 0.62 |
| 0.1% | 3 | 0.50 |
| 0.1% (Neutralized) | 0 | 0.72 |
| 0.1% (Neutralized) | 5 | 0.65 |
| 0.1% (Neutralized) | 10 | 0.54 |

Example 2

Separate samples of a southern softwood kraft pulp (available from Kimberly-Clark Corporation under the designation CR54 southern softwood kraft pulp) were prepared by mixing a sample of the pulp with water to form a mixture having a consistency of about 2 weight percent cellulosic fibers. If a catalyst was used, the catalyst was added to the 2 weight percent cellulosic fiber aqueous solution and the pH of the solution was measured. The 2 weight percent cellulosic fiber aqueous mixture was then centrifuged until the mixture had a consistency of about 33 weight percent cellulosic fibers. The mixtures were then dried at a temperature of about 50° C. until the mixture had a water content of about 6 weight percent, based on the weight of the cellulosic fibers. The samples were then placed in an air through oven at a temperature of about 150° C. for various periods of time. Table 3 lists the catalyst used, the amount of catalyst used as both a weight percent and as a pH measurement, the length of heat treatment, and the measured Water Retention value for each sample.

TABLE 2

| Catalyst | Catalyst Add-On/pH | Time, minutes | Water Retention (g/g) |
|---|---|---|---|
| None | — | 5 | 0.80 |
| None | — | 10 | 0.76 |
| None | — | 20 | 0.79 |
| None | — | 40 | 0.71 |
| Cupric Acetate | 0.003% Cu/4.5 | 10 | 0.80 |
| Cupric Acetate | 0.003% Cu/4.5 | 20 | 0.74 |
| Cupric Acetate | 0.03% Cu/5.2 | 10 | 0.74 |
| Cupric Acetate | 0.03% Cu/5.2 | 20 | 0.71 |
| Ferric Chloride | 0.003% Fe/4.8 | 10 | 0.72 |
| Ferric Chloride | 0.003% Fe/4.8 | 20 | 0.68 |
| Ferric Chloride | 0.03% Fe/2.6 | 5 | 0.64 |
| Ferric Chloride | 0.03% Fe/2.6 | 10 | 0.53 |
| Ferric Chloride | 0.03% Fe/2.6 | 20 | 0.55 |
| Aluminum Sulfate.16 $H_2O$ | 0.002% Al/3.6 | 10 | 0.70 |
| Aluminum Sulfate.16 $H_2O$ | 0.002% Al/3.6 | 20 | 0.67 |
| Aluminum Sulfate.16 $H_2O$ | 0.03% Al/3.2 | 10 | 0.60 |
| Aluminum Sulfate.16 $H_2O$ | 0.03% Al/3.2 | 20 | 0.50 |
| Sodium Bisulfite | 0.03%/4.2 | 10 | 0.83 |
| Sodium Bisulfite | 0.03%/4.2 | 20 | 0.80 |
| Boric Acid | 0.03%/5.1 | 10 | 0.81 |
| Boric Acid | 0.03%/5.1 | 20 | 0.79 |

Example 3

Cellulosic fiber samples were prepared by mixing a southern softwood kraft pulp (available from Kimberly-Clark Corporation under the designation CR54 southern softwood kraft pulp) with water to form a mixture having a consistency of about 2 weight percent cellulosic fibers. If phosphoric acid was used as a crosslinking catalyst, the phosphoric acid was added to the 2 weight percent cellulosic fiber aqueous solution in an amount to give a 0.1 weight percent phosphoric acid, based on the weight of the cellulosic fibers, and the pH of the solution was measured. The 2 weight percent cellulosic fiber aqueous mixture was then centrifuged until the mixture had a consistency of about 33 weight percent cellulosic fibers. Some of the mixtures were then air dried at a temperature of about 50° C. until the mixture had a water content of about 8 weight percent, based on the weight of the cellulosic fibers. Some of the mixtures were then oven dried at a temperature of about 50° C. until the mixture had a water content of about 8 weight percent, based on the weight of the cellulosic fibers. The rest of the mixtures were dried in a microwave oven until the mixture had a water content of about 0 weight percent, based on the weight of the cellulosic fibers.

Some of the samples were then treated under high temperature conditions using the pulse combustion burner furnace used in Example 1. Other samples were treated under high temperature conditions using the air through oven used in Example 2. The results of these evaluations are summarized in Table 3, which lists the amount of phosphoric acid used, if any, and the pH of the sample; the type of drying equipment and/or conditions used; the type of equipment used for the high temperature treatment; the temperature used for the high temperature treatment; the amount of time of the high temperature treatment; and the Water Retention value (WRV) for each sample.

TABLE 3

| Catalyst % Add-on/pH) | Drying Technique | Heat Treatment Equipment | Temp, (°C.) | Time | WRV, g/g |
|---|---|---|---|---|---|
| None | Air-dried | None | — | — | 1.22 |
| None | Air-dried | None | 105 | 60 min | 1.05 |
| None | Microwave-dried | Air-through oven | 150 | 5 min | 0.80 |
| None | Microwave-dried | Air-through oven | 150 | 10 min | 0.76 |
| None | Microwave-dried | Air-through oven | 150 | 20 min | 0.79 |
| None | Microwave-dried | Air-through oven | 150 | 40 min | 0.71 |
| None | Air-dried | Air-through oven | 170 | 60 min | 0.89 |
| None | Oven-dried | Air-through oven | 170 | 60 min | 0.83 |
| None | Oven-dried | Air-through oven | 200 | 20 min | 0.60 |
| None | Air-dried | Air-through oven | 200 | 60 min | 0.65 |
| None | Oven-dried | Air-through oven | 200 | 60 min | 0.58 |
| None | Oven-dried | Air-through oven | 205 | 5 min | 0.64 |
| None | Air-dried | Pulse combustion | 220 | 10 sec | 0.73 |
| None | Air-dried | Pulse combustion | 220 | 20 sec | 0.68 |
| None | Air-dried | Pulse combustion | 270 | 5 sec | 0.67 |
| None | Air-dried | Pulse combustion | 270 | 10 sec | 0.58 |
| 0.03%/2.9 | Microwave-dried | Air-through oven | 150 | 5 min | 0.74 |
| 0.03%/2.9 | Microwave-dried | Air-through oven | 150 | 10 min | 0.71 |
| 0.03%/2.9 | Microwave-dried | Air-through oven | 150 | 20 min | 0.66 |
| 0.03%/2.9 | Microwave-dried | Air-through oven | 150 | 40 min | 0.61 |
| 0.08%/2.5 | Microwave-dried | Air-through oven | 150 | 5 min | 0.67 |
| 0.08%/2.5 | Microwave-dried | Air-through oven | 150 | 10 min | 0.63 |
| 0.08%/2.5 | Microwave-dried | Air-through oven | 150 | 20 min | 0.62 |
| 0.08%/2.5 | Microwave-dried | Air-through oven | 150 | 40 min | 0.56 |
| 0.1%/2.5 | Microwave-dried | Air-through oven | 150 | 10 min | 0.72 |
| 0.1%/2.5 | Microwave-dried | Air-through oven | 150 | 20 min | 0.71 |
| 0.3%/2.2 | Microwave-dried | Air-through oven | 150 | 5 min | 0.56 |
| 0.3%/2.2 | Microwave-dried | Air-through oven | 150 | 10 min | 0.54 |
| 0.3%/2.2 | Microwave-dried | Air-through oven | 150 | 20 min | 0.55 |
| 0.3%/2.2 | Microwave-dried | Air-through oven | 150 | 40 min | 0.54 |
| 0.08%/2.5 | Air-dried | Pulse combustion | 190 | 10 sec | 0.66 |
| 0.08%/2.5 | Air-dried | Pulse combustion | 190 | 20 sec | 0.60 |
| 0.08%/2.5 | Air-dried | Pulse combustion | 190 | 40 sec | 0.52 |
| 0.08%/2.5 | Air-dried | Pulse combustion | 220 | 10 sec | 0.53 |
| 0.08%/2.5 | Air-dried | Pulse combustion | 220 | 20 sec | 0.53 |

Example 4

Separate samples of a southern softwood kraft pulp (available from Kimberly-Clark Corporation under the designation CR54 southern softwood kraft pulp) were prepared by mixing a sample of the pulp with water to form a mixture having a consistency of about 2 weight percent cellulosic fibers. If a catalyst was used, the catalyst was added to the 2 weight percent cellulosic fiber aqueous solution and the pH of the solution was measured. The 2 weight percent cellulosic fiber aqueous mixture was then centrifuged until the mixture had a consistency of about 33 weight percent cellulosic fibers. The mixtures were then dried at a temperature of about 50° C. until the mixture had a water content of about 6 weight percent, based on the weight of the cellulosic fibers. The samples were then placed on top of a laboratory heating element set at various temperatures. Table 4 lists the catalyst used; the amount of catalyst used as a weight percent; the temperature of the heat treatment; the length of heat treatment, and the measured Water Retention value for each sample. One catalyst used was a zirconium-containing material, available from Magnesium Elektron, Manchester, England, under the designation Bacote zirconium-containing material.

TABLE 4

| Catalyst | Catalyst Add-On | Temp, (°C.) | Time, seconds | Water Retention (g/g) |
|---|---|---|---|---|
| None | — | 220 | 5 | 0.74 |
| None | — | 220 | 10 | 0.73 |
| None | — | 220 | 20 | 0.68 |
| None | — | 250 | 5 | 0.70 |
| None | — | 250 | 10 | 0.68 |
| None | — | 270 | 5 | 0.67 |
| None | — | 270 | 10 | 0.59 |
| None | — | 280 | 5 | 0.61 |
| None | — | 280 | 10 | 0.61 |
| Phosphoric Acid | 0.3% | 190 | 10 | 0.66 |
| Phosphoric Acid | 0.3% | 190 | 20 | 0.60 |
| Phosphoric Acid | 0.3% | 190 | 40 | 0.52 |
| Phosphoric Acid | 0.3% | 220 | 10 | 0.53 |
| Phosphoric Acid | 0.3% | 220 | 20 | 0.53 |
| Phosphoric Acid | 0.1% | 250 | 10 | 0.70 |
| Phosphoric Acid | 0.1% | 280 | 5 | 0.61 |
| Phosphoric acid | 0.1% | 280 | 10 | 0.61 |
| Phosphoric Acid | 0.08% | 220 | 5 | 0.58 |
| Phosphoric Acid | 0.08% | 250 | 5 | 0.54 |
| Phosphoric Acid | 0.08% | 280 | 5 | 0.49 |
| Phosphoric Acid | 0.08% | 280 | 10 | 0.49 |

TABLE 4-continued

| Catalyst | Catalyst Add-On | Temp, (°C.) | Time, seconds | Water Retention (g/g) |
|---|---|---|---|---|
| Aluminum Sulfate.16 $H_2O$ | 0.03% Al | 220 | 5 | 0.50 |
| Aluminum Sulfate.16 $H_2O$ | 0.03% Al | 220 | 10 | 0.59 |
| Bacote | 0.03% Zr | 220 | 5 | 0.74 |
| Bacote | 0.03% Zr | 220 | 10 | 0.68 |
| Bacote | 0.03% Zr | 250 | 5 | 0.66 |
| Bacote | 0.03% Zr | 250 | 10 | 0.61 |

Example 5

The effect of the form in which cellulosic fibers are heat treated on the properties exhibited by the heat-treated cellulosic fibers was studied. Two different types of cellulosic fibers were studied. The first was a southern softwood kraft pulp (available from Kimberly-Clark Corporation under the designation CR54 southern softwood kraft pulp). The second was a southern hardwood kraft pulp (available from Kimberly-Clark Corporation under the designation CR57 southern softwood kraft pulp).

The different forms in which the cellulosic fibers were studied included the following: a Pulp Mill Sheet, which represents a cellulosic fiber sheet as received from a pulp mill at 433 lbs/3,000 square feet; an Air-Laid Sheet, which represents a cellulosic fiber sheet formed with an air laying process using a Continuous Energy Transfer (CET) unit, which is a modified hammermill-like device, such as is disclosed in U.S. Pat. No. 4,650,127, to Fred Radwanski et al., U.S. Pat. No. 4,701,294, to Fred Radwanski et al., and U.S. Pat. No. 4,767,586, to Fred Radwanski et al., each hereby incorporated in their entirety by reference; Fiberized Fibers, which represents cellulosic fibers which have been refined using a Pallmann Company model no. REF-41 fiberizer; Refined Fibers, which represents cellulosic fibers which have been refined using a Bivis KRO 102 refiner by Clextral, ZI de Chazeau, France.

If a catalyst was used, the catalyst was added to the 2 weight percent cellulosic fiber aqueous solution. The 2 weight percent cellulosic fiber aqueous mixture was then centrifuged until the mixture had a consistency of about 33 weight percent cellulosic fibers. The mixtures were then dried at a temperature of about 50° C. until the mixture had a water content of about 6 weight percent, based on the weight of the cellulosic fibers.

Some samples were treated under high temperature conditions using the air through oven used in Example 2. Other samples were treated under high temperature conditions using a Fluid Energy Aljet Model 4 ThermaJet flash drying system, available from Fluid Energy Aljet, Plumsteadville, Pa.

The results are summarized in Table 5 which summarizes the type of cellulosic fiber used; the form of the cellulosic fiber used; the amount of phosphoric acid catalyst used, if any; the heat treatment equipment used; the heat treatment temperature used; the amount of time the heat treatment was conducted; and the Wet Curl value for each sample.

TABLE 5

| Cellulosic Fiber Type | Form of Cellulosic Fibers | Catalyst ($H_3PO_4$) Add-On | Heat Treatment Equipment | Heat Treatment Temp. (°C.) | Heat Treatment Time | Wet Curl value |
|---|---|---|---|---|---|---|
| Softwood | Pulp Mill Sheet | — | — | — | — | 0.09 |
| Softwood | Air-Laid Sheet | — | — | — | — | 0.09 |
| Softwood | Fiberized Fibers | — | — | — | — | 0.10 |
| Softwood | Refined Fibers | — | — | — | — | 0.19 |
| Softwood | Fiberized Fibers | — | Air-through oven | 150 | 20 min | 0.18 |
| Softwood | Pulp Mill Sheet | — | Air-through oven | 200 | 20 min | 0.10 |
| Softwood | Air-Laid Sheet | — | Air-through oven | 200 | 20 min | 0.11 |
| Softwood | Fiberized Fibers | — | Air-through oven | 200 | 20 min | 0.15 |
| Softwood | Refined Fibers | — | Air-through oven | 200 | 20 min | 0.22 |
| Softwood | Pulp Mill Sheet | — | Air-through oven | 230 | 5 min | 0.11 |
| Softwood | Air-Laid Sheet | — | Air-through oven | 230 | 5 min | 0.11 |
| Softwood | Fiberized Fibers | — | Air-through oven | 230 | 5 min | 0.15 |
| Softwood | Refined Fibers | — | Air-through oven | 230 | 5 min | 0.25 |
| Softwood | Air-Laid Sheet | — | Aljet flash dryer | 300 | 2 sec | 0.18 |
| Softwood | Fiberized Fibers | 0.1 % | Air-through oven | 150 | 20 min | 0.19 |
| Hardwood | Pulp Mill Sheet | — | — | — | — | 0.13 |
| Hardwood | Fiberized Fibers | — | Air-through oven | 150 | 20 min | 0.16 |
| Hardwood | Fiberized Fibers | 0.1 % | Air-through oven | 150 | 20 min | 0.17 |

Those skilled in the art will recognize that the present invention is capable of many modifications and variations without departing from the scope thereof. Accordingly, the detailed description and examples set forth above are meant to be illustrative only and are not intended to limit, in any manner, the scope of the invention as set forth in the appended claims.

What is claimed is:

1. A process for the treatment of cellulosic fibers, the process comprising treating cellulosic fibers in dry air, wherein the cellulosic fibers are used in a weight amount and comprise less than about 15 weight percent of water, based on the weight of the cellulosic fibers, at a temperature that is between about 150° C. to about 300° C. for an amount of time that is effective to result in modified cellulosic fibers that exhibit a Water Retention value that is less than about 1.0 gram per gram.

2. The process of claim 1 wherein the cellulosic fibers are from a wood source.

3. The process of claim 1 wherein the cellulosic fibers are treated at a temperature that is between about 150° C. to about 250° C.

4. The process of claim 3 wherein the cellulosic fibers are treated at a temperature that is between about 170° C. to about 250° C.

5. The process of claim 1 wherein the cellulosic fibers are treated for an amount of time that is between about 1 second to about 300 minutes.

6. The process of claim 1 wherein the cellulosic fibers comprise less than about 10 weight percent of water, based on the weight of the cellulosic fibers.

7. The process of claim 1 wherein the modified cellulosic fibers exhibit a Water Retention value that is less than about 0.9 gram per gram.

8. The process of claim 7 wherein the modified cellulosic fibers exhibit a Water Retention value that is less than about 0.8 gram per gram.

9. The process of claim 8 wherein the modified cellulosic fibers exhibit a Water Retention value that is less than about 0.7 gram per gram.

10. The process of claim 1 further comprising mixing the dry cellulosic fibers with a heat-treatment catalyst.

11. The process of claim 10 wherein the heat-treatment catalyst is selected from the group consisting of phosphoric acid, cupric acetate, ferric chloride, aluminum sulfate, sodium bisulfite, boric acid, bacote, and mixtures thereof.

12. The process of claim 10 wherein the heat-treatment catalyst is used in an amount between about 0.001 weight percent to about 1 weight percent based on the total weight of cellulosic fibers.

13. The process of claim 1 wherein the modified cellulosic fibers exhibit a Wet Curl value that is greater than about 0.10.

14. The process of claim 13 wherein the modified cellulosic fibers exhibit a Wet Curl value that is between about 0.11 to about 0.3.

15. A modified cellulosic fiber that is prepared by a process comprising treating a cellulosic fiber in dry air, wherein the cellulosic fiber is used in a weight amount and comprises less than about 15 weight percent of water, based on the weight of the cellulosic fiber, at a temperature that is between about 150° C. to about 300° C. for an amount of time that is effective to result in the modified cellulosic fiber exhibiting a Water Retention value that is less than about 1.0 gram per gram.

16. The modified cellulosic fiber of claim 15 wherein the cellulosic fiber is from a wood source.

17. The modified cellulosic fiber of claim 15 wherein the cellulosic fiber is treated at a temperature that is between about 150° C. to about 250° C.

18. The modified cellulosic fiber of claim 17 wherein the cellulosic fiber is treated at a temperature that is between about 170° C. to about 250° C.

19. The modified cellulosic fiber of claim 16 wherein the cellulosic fiber is treated for an amount of time that is between about 1 second to about 300 minutes.

20. The modified cellulosic fiber of claim 15 wherein the cellulosic fiber comprises less than about 10 weight percent of water, based on the weight of the cellulosic fiber.

21. The modified cellulosic fiber of claim 15 wherein the modified cellulosic fiber exhibits a Water Retention value that is less than about 0.9 gram per gram.

22. The modified cellulosic fiber of claim 21 wherein the modified cellulosic fiber exhibits a Water Retention value that is less than about 0.8 gram per gram.

23. The modified cellulosic fiber of claim 22 wherein the modified cellulosic fiber exhibits a Water Retention value that is less than about 0.7 gram per gram.

24. The modified cellulosic fiber of claim 16 wherein the modified cellulosic fiber exhibits a Wet Curl value that is greater than about 0.10.

25. The modified cellulosic fiber of claim 24 wherein the modified cellulosic fiber exhibits a Wet Curl value that is between about 0.11 to about 0.3.

* * * * *